United States Patent [19]

Will

[11] Patent Number: 4,480,158

[45] Date of Patent: Oct. 30, 1984

[54] TIME DELAY SWITCHING DEVICE

[75] Inventor: Walter Will, Wuppertal, Fed. Rep. of Germany

[73] Assignee: Westinghouse FANAL-Schaltgeräte GmbH, Wuppertal, Fed. Rep. of Germany

[21] Appl. No.: 466,936

[22] Filed: Feb. 16, 1983

[30] Foreign Application Priority Data

Feb. 16, 1982 [DE] Fed. Rep. of Germany ..... 3205406

[51] Int. Cl.[3] ..... H01H 7/03; H01H 43/00

[52] U.S. Cl. ..... 200/34; 335/61

[58] Field of Search ..... 335/61, 62, 63, 59, 335/60; 200/34, 61.5, 83 T

[56] References Cited

U.S. PATENT DOCUMENTS 4,179,676 12/1979 Selas ..... 335/61 X

*Primary Examiner*—J. R. Scott

*Attorney, Agent, or Firm*—Antonelli, Terry & Wands

[57] ABSTRACT

A time-delay switching device which includes a pneumatic timer adapted to be triggered by an electromagnet. The switching device includes at least two switches, with each switch including a movable switching element for controlling switching operations in, for example, a wye-delta control circuit. The time delay switching device is constructed in such a fashion that a specified switching pause occurs between an actuation of the two switches and/or an actuation of a second group of switches. One of the switches includes a movable switch element which is influenced immediately after the expiration of a time delay period by the pneumatic timer. A movable switching element of the other switch is coupled with the first switching element by a buffer which is adapted to transmit a switching movement on a delayed basis. The buffer may take the form of a mechanical or pneumatic compression spring.

19 Claims, 4 Drawing Figures

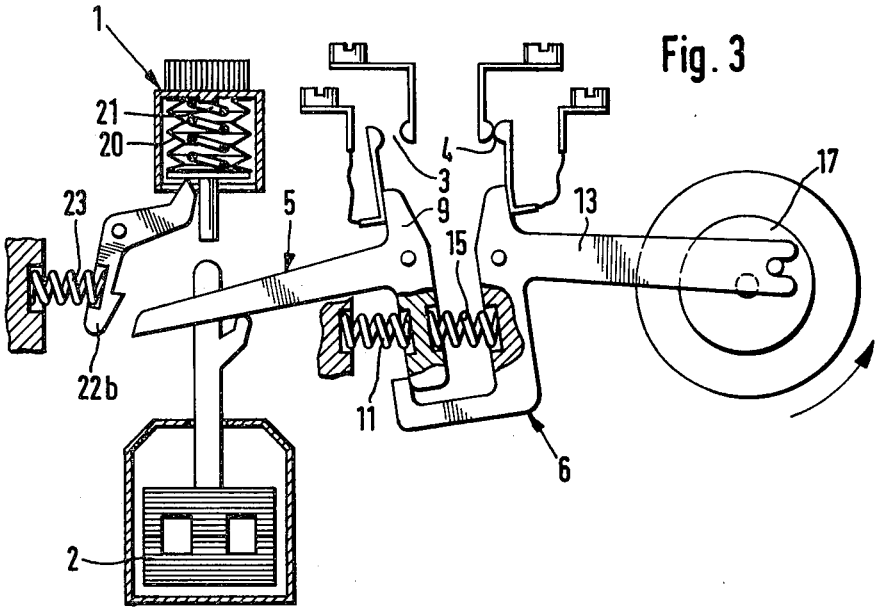
Fig. 3
Fig. 4
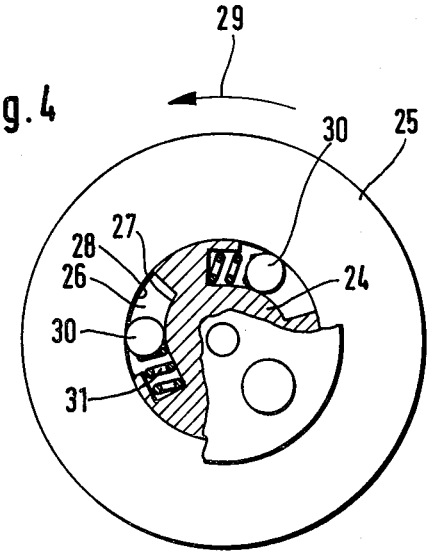

TIME DELAY SWITCHING DEVICE

BACKGROUND OF THE INVENTION

1. Field of the Invention

The present invention relates to a switch arrangement and, more particularly, to a time delay switching device which includes at least two switches and a pneumatic timer triggerable by an electromagnetic means, with each of the at least two switches having a movable switching element in order to enable a control of operating sequences in, for example, wye-delta circuits.

2. Prior Art

Time delay switching devices actuated by electromagnetic means have been proposed, usually in the form of accessories, wherein switches of the switching device switch directly and jointly after a delay period has elapsed, with only the distances which the individual bridges of the switches must travel producing a slight difference in the switching time and, in actual practice, the break contacts assume an open position a few milliseconds before the make contacts close.

Switching devices of the aforementioned type are used extensively in sequential controls which require a time delay switching operation. In certain applications such as, for example, in star or wye-delta circuits, the nearly simultaneous switching moment of the break contacts and make contacts which switch over after a delay time has elaspsed lead to certain technical problems. As a rule, despite the generally conventional electrical interlocking, the pause in the switching operation between a wye operation and delta operation is insufficient to extinguish the arc which appears at the contacts of the wye switch before the contacts of the delta switch have contacted another. In, for example, electric motors, a disadvantage of the above noted electrical interlocking resides in the fact that arc-air shorts result as well as the generation of magnetic residual fields.

In order to avoid the above noted disadvantages, mechanical time delay relays especially designed for wye-delta contactors have been proposed, with the relays including switches provided with a switching pause between the opening of the break contacts and closing of the make contacts. Additionally, electronic time delay relays have also been proposed for wye-delta contactors which, for the reasons noted above, employ two output relays. A disadvantage of employing two completely indendently operating time delay relays resides in the fact that a relatively high cost is incurred and, moreover, the provision of a number of different voltage ranges are necessary to adapt the control voltage of the wye-delta contactors.

SUMMARY OF THE INVENTION

The aim underlying the present invention essentially resides in providing a time delay switching device of the aformentioned type, triggerable by an electromagnetic means, which provides a definite switch pause between the actuation of the at least two switches of the switching device or an actuation of two groups of switches.

In accordance with advantageous features of the present invention, only one of the movable switching elements is influenced immediately after an expiration of a delay period by a pneumatic timing element, with the other movable switching element being coupled to a master switching element through a buffer which transmits the switching movement on a delayed basis.

Advantageously, the buffer may be formed as a mechanical or pneumatic compression spring. A buffer of this type is initially more or less compressed when the first switching element is actuated, prior to the switching movement of the first switching element being transmitted to the second switching element. By this arrangement a definite pause is produced between the two switching processes.

The production of the definite pause between the switching processes makes it possible, in accordance with a further feature of the present invention, to fix a sufficient period of time for the slave switching element to be connected with an inert mass so that the slave switching element starts moving only after a considerable compression of the buffer.

Preferably, in accordance with the present invention, the movable switching elements may be in the form of switch levers and the inert mass may be in the form of a rotational mass rotatable about an axle which is integrally formed with a switch housing, with the slave switching lever being articulated to the rotatable mass by a crank arm. In this manner, it is possible to produce a relatively long pause between the two switching processes with very small structural dimensions of the switching device.

In, for example, a wye-delta control arrangement, in accordance with the present invention, a master switching lever may actuate a break contact with a slave switching lever actuating a make contact. To prevent the make contact from bouncing, in accordance with further features of the present invention, provision may be made such that the rotatable mass may include a pawl articulated to the slave switching lever and an outer solid ring, equipped with a brake lining, with the ring being rotatable in one direction on the core through, for example, a free-running clutch.

In order to achieve a very sturdy and functionally realiable construction, according to the present invention, the master switch lever may be released by means of a pawl arrangement controlled by a pneumatic time at a point in time immediately after the set delay time expires for enabling an actuation by a switching power spring.

Preferrably, the master switch lever is in the form of a T-shaped lever and includes a contact lever arm, a pawl arm cooperating with a timing element, and a power arm tensioned by the switching power spring and coupled with the slave switching lever. Advantageously, the slave switching lever is provided on the pressure spring side with a stop and a retainer which fits behind the master switch lever and limits the relative movement of the two switching levers.

Accordingly, it is an object of the present invention to provide a time delay switching device which avoids, by simple means, shortcomings and disadvantages encountered in the prior art.

Another object of the present invention resides in providing a time delay switching device for controlling a positioning of at least two switches or groups of switches which ensures the production of a definite pause between two switching processes.

Yet another object of the present invention resides in providing a time-delay switching device which is simple in construction and therefore relatively inexpensive to manufacture.

Yet another object of the present invention resides in providing a time-delay switching device having small structural overall dimensions.

A still further object of the present invention resides in providing a time delay switching device having at least two switches or two groups of switches and a pneumatic timer triggerable by an electromagnetic means, which functions realiably under all operating conditions.

These and other objects, features, and advantages of the present invention will become more apparent from the following description when taken in connection with the accompanying drawings which show, for the purposes of illustration only, one embodiment in accordance with the present invention, and wherein:

BRIEF DESCRIPTION OF THE DRAWING

FIG. 3 is a partial cross sectional view of the time delay switching device of FIG. 1 in an operating position after all switching processes have occurred; and FIG. 4 is a partial cross sectional view of a free running clutch of a switching device constructed in accordance with the present invention.

DESCRIPTION OF THE PREFERRED EMBODIMENT

Figure 1:
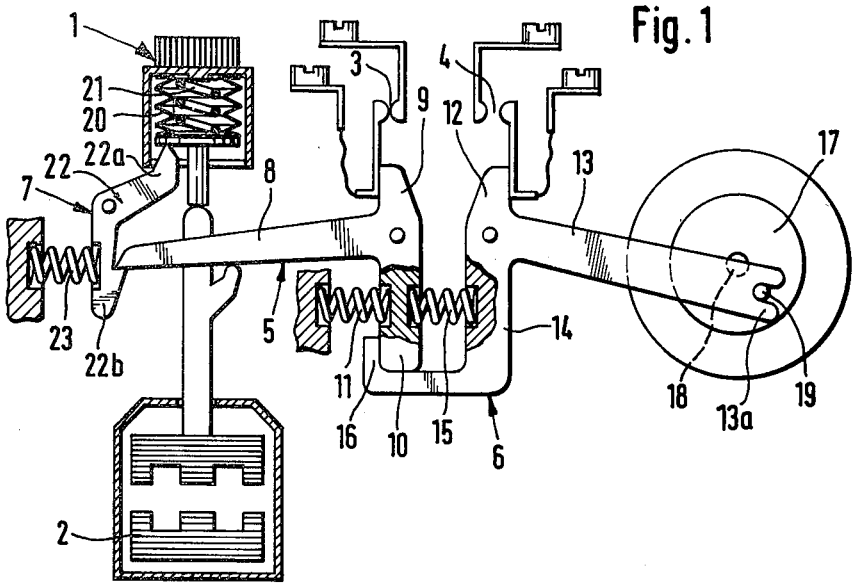
FIG. 1 is a partial cross sectional schematic view of a time delay switching device constructed in accordance with the present invention in a rest position.

Referring now to the drawings wherein like reference numerals are used throughout the various views to designate like parts and, more particularly, to FIG, 1, according to this Figure, a time-delay switching device includes a pneumatic timer means generally designated by the reference numeral 1, actuatable by an electromagnetic means 2 to control a positioning of a break switch 3 and a make switch 4, with one movable switching member or switching element generally designated by the reference numerals 5, 6 being respectively provided for the switches 3, 4. A pawl arrangement generally designated by the reference numeral 7 is arranged between the pneumatic timer 1 and a movable master switching element 5. The movable master switching element 5 is fashioned as a pivotally mounted substantially T-shaped switching lever and includes a pawl arm 8, a contact lever arm 9, and a force arm 10. The switching element 5 is tensioned at its force arm 10 by a switching force spring 11 in such a direction so as to normally bias the break switch 3 in an open direction. The movable slave switching element 6 is fashioned as a pivotable switch lever and includes a contact lever arm 12, a mass crank arm 13, and an actuating arm 14. The force arm 10 of the master switching element 5 and actuating arm 14 of the slave switching element 6 are coupled together by a buffer means 15 connected between them, with the buffer means 15 being constructed, for example, as a helical compression spring. A stop or catch 16 is provided on the actuating arm 14 for enabling an engagement of the power arm 10 of the master switching element 5.

The mass crank arm 13 is advantageously connected to an inert mass generally designated by the reference numeral 17 rotatably mounted in a housing (not shown) about an axle 18. For this purpose, the mass crank arm 13 is provided with a fork-shaped end 13*a* adapted to receive a pin 19 to thereby articulatingly connect the mass crank arm 13 to the mass 17.

Figure 2:
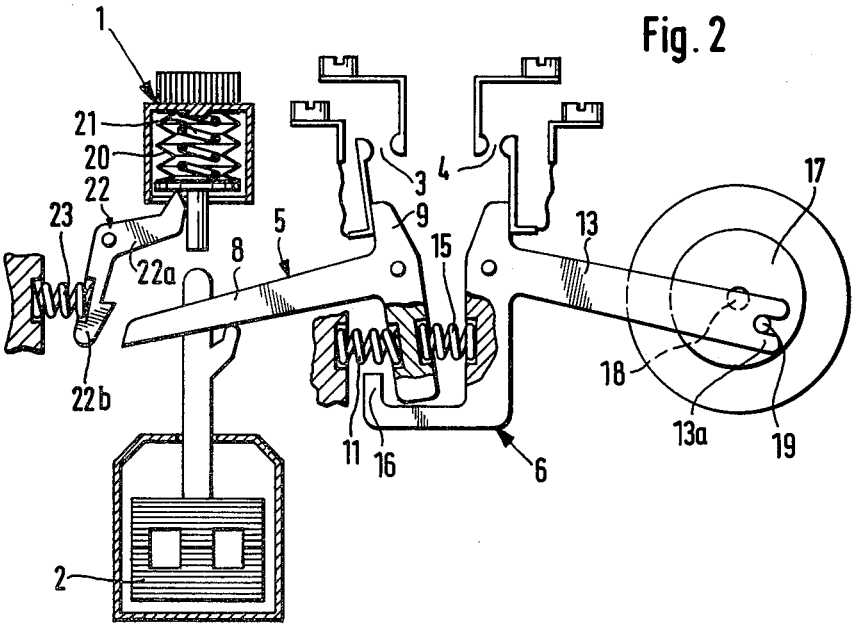
FIG. 2 is a partial cross sectional view of the time delay switching device of FIG. 1 in an operating position immediately after an expiration of a set delay time.

When the electromagnetic means 2 is actuated, the pneumatic system of the pneumatic timing element is released, and a bellows 20 of the timing element 1 fills itself with air in a set time period under a forcible action of a compression spring 21 disposed in the bellows 20. After the set delay period of the timing element 1 has expired, the bellows 20 exerts a force upon an arm 22*a* of an angled pawl lever generally designated by the reference numeral 22 so as to pivot the pawl lever 22 against the force of a compression spring 23 applying force to the other arm 22*b* of the pawl lever 22 thereby unlocking the switching element 5 after the set delay period has lapsed. Upon an unlocking of the switching element 5, as shown most clearly in FIG. 2, the switching force spring 11 immediately opens the contacts of the break switch 3 and simultaneously tensions the buffer means 15. The torque exerted by the buffer means 15 on the switching element 6 is braked by the inert mass 17 so that the make switch 4 closes only after a time delay and, as shown in FIG. 3, the stop or catch 16 limits the rotary movement of the switching element 6.

A braking of the switching element 6 against the stop or catch 16 permits the energy stored in the mass 17 to exert a rebound effect upon the switching element 6 which, in a least favorable case, would lead to a reopening of the make switch 4. To avoid this, as shown most clearly in FIG. 4, the inert mass is provided with a free running clutch means. More particularly, the rotatably mounted mass 17 includes a core 24 and an outer solid ring 25 which delimit spaces 26. The core 24 includes surface portions 27 disposed in opposition to an inner peripheral surface 28 of the outer solid ring 25. The surfaces 27, 28 are arranged so as to diverge in a direction of rotation 29 of the rotatably mounted mass 17. A roller element 30 in the form of; for example, a ball or a cylinder, is disposed in each cavity or space 26, with the roller element 30 being forced or urged by a compression spring 31 in a direction opposite the direction of rotation 29 until the roller element 30 is jammed between the diverging surfaces 27, 28. If the core 24 is moved in the direction of rotation 29, the outer solid ring 25 is entrained by the wedging action of the roller elements 30.

When the switching element 6 reaches the stop or catch 16, the stored energy permits the outer solid ring 25 to continue rotating, whereby the rotation of the outer solid ring 25 in the direction of rotation 29 eliminates the wedging action of the roller elements 30 relative to the fixed core 24. The friction that results in the process between the outer solid ring 25 and core 24 prevents the core 24 from rebounding or bouncing back. Since the outer solid ring continues moving while simultaneously exerting friction on the core 24, a reopening of the contacts of the make switch 4 is realiably prevented.

While I have shown and described only one embodiment in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

I claim:

1. A time delay switching device comprising at least two switch means, timer means for controlling a time of actuation of the switch means, each of said switch means includes a movable switching member adapted to control a switching operation of the switch means, means for operatively connecting one of said movable switching members to said timer means so as to immediately influence a positioning thereof after an expiration of a time delay of the timer means, and means for coupling the other of the movable switching members to said one movable switching member so as to transmit a switching movement to the other movable switching member with a time delay.

2. A time delay switching device according to claim 1, wherein said timer means includes a pneumatic means adapted to be triggered by an electromagnetic means.

3. A time delay switching device according to claim 2, wherein said means for coupling includes a buffer means interposed between said movable switching members, and wherein means are provided for braking the movement of said other movable switching member, whereby the switch means associated with the other movable switching member is operated after a further time delay.

4. A time delay switching device according to claim 3, wherein said means for braking includes a mass means connected to the other movable switching member.

5. A time delay switching device according to claim 3, wherein said movable switching members are formed as switch levers, the means for braking includes mass means rotatably mounted about an axle means integrally formed with a housing of the switching device, and wherein the switch lever of said other movable switch member includes a crank arm articulatingly connected to the mass means.

6. A time delay switching device according to claim 2, wherein one of said switch means functions as a break contact and the other switch means functions as a make contact, and wherein said one of said movable switching members actuates the break contact and the other of said movable switching members actuates the make contact.

7. A time delay switching device according to claim 5, wherein said mass means includes a core member, an outer solid ring member, and means for mounting said solid ring member so as to be rotatable in one direction, and wherein said switch lever of said other movable switch member is articulated to said core member.

8. A time delay switching device according to claim 7, wherein means are interposed between said core member and said solid ring member for exerting a braking friction.

9. A time delay switching device according to claim 8, wherein said means for operatively connecting said one of said movable switching members to said timer means includes a pivotally mounted pawl means interposed between said timer means and said one of said movable switching members for releasably holding said one of said movable switching members, and wherein means are provided for immediately applying a force upon said one of said switching members upon a release by said pawl means.

10. A time delay switching device according to claim 9, wherein said one of said movable switching members has a substantially T-shaped configuration and includes a contact lever arm, a pawl arm cooperable with said pawl means, and a force arm acted upon by said force applying means and cooperable with said means for coupling.

11. A time delay switching device according to claim 10, wherein said means for coupling includes a catch means provided on said other of said movable switching members cooperable with an end of said force arm, said catch means being arranged on a side of said other of said movable switching members facing said buffer means.

12. A time delay switching device according to claim 11, wherein said buffer means includes a compression spring.

13. A time delay switching device according to claim 12, wherein said switch means is adapted to control a wye-delta control circuit.

14. A time delay switching device according to claim 1, wherein said means for coupling includes a buffer means interposed between said movable switching members, and wherein means are provided for braking the movement of said other movable switching member, whereby the switch means associated with the other movable switching member is operated after a further time delay.

15. A time delay switching device according to claim 14, wherein said means for braking includes a mass means connected to the other switching member.

16. A time delay switching device according to claim 14, wherein said movable switching members are formed as switch levers, the means for braking includes mass means rotatably mounted about an axle means integrally formed with a housing of the switching device, and wherein the switch level of said other movable switch member includes a crank arm articulatingly connected to the mass means.

17. A time delay switching device according to claim 1, wherein said means for operatively connecting said one of said movable switching members to said timer means includes a pivotally mounted pawl means interposed between said timer means and said one of said movable switching members for releasably holding said one of said movable switching members, and wherein means are provided for immediately applying a force upon said one of said movable switching members upon a release by said pawl means.

18. A time delay switching device according to claim 17, wherein said means for coupling includes a catch means provided on said other of said movable switching members cooperable with an end of said one of said movable switching members.

19. A time delay switching device according to claim 1, wherein said switch means is adapted to control a wye-delta control circuit.

* * * * *